US009261317B2

(12) United States Patent
Daniel et al.

(10) Patent No.: US 9,261,317 B2
(45) Date of Patent: Feb. 16, 2016

(54) SUPPRESSOR ASSEMBLY FOR A FIREARM

(71) Applicant: Daniel Defense, Inc., Black Creek, GA (US)

(72) Inventors: Marvin C. Daniel, Pooler, GA (US); Dewayne Lee Thompson, Lexington, KY (US)

(73) Assignee: Daniel Defense, Inc., Black Creek, GA (US)

( * ) Notice: Subject to any disclaimer, the term of this patent is extended or adjusted under 35 U.S.C. 154(b) by 0 days.

(21) Appl. No.: 14/790,736

(22) Filed: Jul. 2, 2015

(65) Prior Publication Data

US 2015/0308773 A1 Oct. 29, 2015

Related U.S. Application Data

(63) Continuation of application No. 13/862,702, filed on Apr. 15, 2013, now Pat. No. 9,103,618.

(60) Provisional application No. 61/750,613, filed on Jan. 9, 2013.

(51) Int. Cl.
*F41A 21/30* (2006.01)

(52) U.S. Cl.
CPC ..... *F41A 21/30* (2013.01)

(58) Field of Classification Search
CPC ..... F41A 21/36; F41A 21/325; F41A 21/30; F41A 5/26
USPC ..... 89/193
See application file for complete search history.

(56) References Cited

U.S. PATENT DOCUMENTS

| | | | | | |
|---|---|---|---|---|---|
| 958,934 | A | | 5/1910 | Maxim | |
| 981,584 | A | | 1/1911 | Miller | |
| 1,017,003 | A | | 2/1912 | Kenney | |
| 1,111,202 | A | | 9/1914 | Westfall | |
| 1,341,363 | A | | 5/1920 | Fiala | |
| 1,401,667 | A | * | 12/1921 | Brown | F41A 3/44 42/70.02 |
| 1,427,802 | A | | 9/1922 | Goodwin | |

(Continued)

FOREIGN PATENT DOCUMENTS

| | | | |
|---|---|---|---|
| AT | 408810 | B | 1/1991 |
| CA | 1193895 | A1 | 8/1982 |

(Continued)

OTHER PUBLICATIONS

International Search Report and Written Opinion for International Application No. PCT/US2014/0101668 mailed Aug. 25, 2014.

*Primary Examiner* — Reginald Tillman, Jr.
(74) *Attorney, Agent, or Firm* — Sutherland Asbill & Brennan LLP

(57) ABSTRACT

A suppressor assembly for a firearm is disclosed herein. The firearm may include a barrel, a bore, and a muzzle end. The suppressor assembly may include a gas block mount positioned about the barrel. The suppressor assembly also may include an outer tube comprising a first end and a second end. The first end of the outer tube may be configured to be attached to the gas block mount, and the second end of the outer tube may be configured to extend beyond the muzzle end of the firearm. Moreover, the suppressor assembly may include a baffle comprising a first end and a second end. The second end of the baffle may be configured to be attached to and positioned within the second end of the outer tube.

18 Claims, 6 Drawing Sheets

(56) References Cited

U.S. PATENT DOCUMENTS

| | | | | |
|---|---|---|---|---|
| 2,375,617 | A | 5/1945 | Bourne | |
| 3,385,164 | A | 5/1968 | Walther et al. | |
| 3,713,362 | A | 1/1973 | Charron | |
| 3,748,956 | A | 7/1973 | Hubner | |
| 3,786,895 | A | 1/1974 | Perrine | |
| 4,291,610 | A | 9/1981 | Waiser | |
| 4,501,189 | A | 2/1985 | Brandl et al. | |
| 4,512,236 | A | 4/1985 | Thevis et al. | |
| 4,530,417 | A | 7/1985 | Daniel | |
| 4,576,083 | A | 3/1986 | Seberger, Jr. | |
| 4,576,084 | A | 3/1986 | Brandl et al. | |
| 4,584,924 | A | 4/1986 | Taguchi | |
| 4,588,043 | A | 5/1986 | Finn | |
| 4,907,488 | A | 3/1990 | Seberger | |
| 4,974,489 | A | 12/1990 | Fishbaugh | |
| 5,029,512 | A | 7/1991 | Latka | |
| 5,136,923 | A | 8/1992 | Walsh, Jr. | |
| 5,136,924 | A | 8/1992 | Forster et al. | |
| 5,164,535 | A | 11/1992 | Leasure | |
| 5,315,914 | A | 5/1994 | Schumacher | |
| 5,325,759 | A | 7/1994 | Warner et al. | |
| 5,361,677 | A | 11/1994 | Warner et al. | |
| 5,476,028 | A | 12/1995 | Seberger | |
| 5,679,916 | A | 10/1997 | Weichert | |
| 5,685,102 | A | 11/1997 | Latka | |
| 5,826,363 | A | 10/1998 | Olson | |
| 5,831,202 | A * | 11/1998 | Rustick | F41A 21/26 42/124 |
| D415,812 | S | 10/1999 | Andrews, Jr. et al. | |
| D415,813 | S | 10/1999 | O'Quinn et al. | |
| 6,079,311 | A | 6/2000 | O'Quinn et al. | |
| D435,623 | S | 12/2000 | Andrews, Jr. et al. | |
| 6,302,009 | B1 | 10/2001 | O'Quinn et al. | |
| 6,308,609 | B1 | 10/2001 | Davies | |
| 6,374,718 | B1 | 4/2002 | Rescigno et al. | |
| 6,412,389 | B2 | 7/2002 | Fluhr | |
| 6,425,310 | B1 | 7/2002 | Champion | |
| 6,575,074 | B1 | 6/2003 | Gaddini | |
| 6,595,099 | B1 | 7/2003 | Olson et al. | |
| 6,701,820 | B2 | 3/2004 | Fluhr | |
| 6,796,214 | B2 | 9/2004 | Hausken et al. | |
| 6,948,415 | B2 | 9/2005 | Matthews et al. | |
| 6,973,863 | B1 | 12/2005 | Jones | |
| 7,013,592 | B2 | 3/2006 | Olson | |
| 7,073,426 | B1 | 7/2006 | White | |
| 7,207,258 | B1 | 4/2007 | Scanlon | |
| 7,237,467 | B1 | 7/2007 | Melton | |
| 7,290,475 | B2 | 11/2007 | Fluhr | |
| 7,308,967 | B1 | 12/2007 | Hoel | |
| 7,412,917 | B2 | 8/2008 | Vais | |
| D577,409 | S | 9/2008 | Brittingham | |
| D577,410 | S | 9/2008 | Brittingham | |
| D582,502 | S | 12/2008 | Brittingham | |
| D582,503 | S | 12/2008 | Brittingham | |
| D584,786 | S | 1/2009 | Brittingham | |
| D584,787 | S | 1/2009 | Brittingham | |
| D585,518 | S | 1/2009 | Brittingham | |
| D591,382 | S | 4/2009 | Brittingham | |
| D594,082 | S | 6/2009 | O'Quinn | |
| D598,066 | S | 8/2009 | Brittingham | |
| 7,587,969 | B2 | 9/2009 | Silvers | |
| 7,588,122 | B2 | 9/2009 | Brittingham | |
| 7,594,464 | B2 | 9/2009 | Dueck | |
| 7,600,606 | B2 | 10/2009 | Brittingham | |
| 7,610,710 | B2 | 11/2009 | Brittingham | |
| 7,610,992 | B2 | 11/2009 | Brittingham | |
| 7,627,974 | B2 | 12/2009 | Olson | |
| D610,221 | S | 2/2010 | Brittingham | |
| 7,661,349 | B1 | 2/2010 | Brittingham | |
| 7,676,976 | B2 | 3/2010 | Dueck et al. | |
| 7,677,150 | B2 | 3/2010 | Dater et al. | |
| 7,735,406 | B1 | 6/2010 | Olson | |
| 7,743,693 | B1 | 6/2010 | Brittingham | |
| 7,789,008 | B2 | 9/2010 | Petersen | |
| 7,789,009 | B1 | 9/2010 | Brittingham | |
| 7,832,323 | B1 | 11/2010 | Davies | |
| 7,856,914 | B2 | 12/2010 | Shults et al. | |
| 7,874,238 | B2 | 1/2011 | Silvers | |
| 7,891,282 | B1 | 2/2011 | DeGroat | |
| 7,891,284 | B1 | 2/2011 | Barrett | |
| 7,895,787 | B1 | 3/2011 | Andry | |
| 7,905,170 | B1 | 3/2011 | Brittingham et al. | |
| 7,905,171 | B1 | 3/2011 | Brittingham | |
| 7,926,404 | B2 | 4/2011 | Brittingham | |
| 7,931,118 | B1 | 4/2011 | Cronhelm | |
| 7,946,069 | B2 | 5/2011 | Dueck et al. | |
| 7,954,414 | B2 | 6/2011 | Dueck | |
| 7,987,944 | B1 | 8/2011 | Brittingham et al. | |
| 8,015,908 | B2 | 9/2011 | Kline et al. | |
| D651,680 | S | 1/2012 | DeGroat | |
| 8,087,338 | B1 | 1/2012 | Hines | |
| 8,091,462 | B2 | 1/2012 | Dueck et al. | |
| 8,096,222 | B2 | 1/2012 | Silvers | |
| 8,100,224 | B1 | 1/2012 | Olson | |
| 8,104,570 | B2 | 1/2012 | Miller et al. | |
| D657,012 | S | 4/2012 | Woodell | |
| 8,162,100 | B2 | 4/2012 | Shults et al. | |
| 8,167,084 | B1 | 5/2012 | Moore | |
| 8,171,840 | B2 | 5/2012 | Kline et al. | |
| 8,205,538 | B2 | 6/2012 | Dueck et al. | |
| 8,209,895 | B2 | 7/2012 | Dueck et al. | |
| 8,210,087 | B2 | 7/2012 | Latka | |
| 8,272,306 | B1 | 9/2012 | Smith | |
| 8,286,750 | B1 | 10/2012 | Oliver | |
| 8,292,025 | B1 | 10/2012 | Woodell et al. | |
| 8,567,556 | B2 | 10/2013 | Dueck et al. | |
| 9,103,618 | B2 * | 8/2015 | Daniel | F41A 21/325 |
| 2005/0115398 | A1 | 6/2005 | Olson | |
| 2005/0150718 | A1 | 7/2005 | Knight et al. | |
| 2005/0229464 | A1 | 10/2005 | Olson et al. | |
| 2006/0060076 | A1 | 3/2006 | Dueck et al. | |
| 2008/0271944 | A1 | 11/2008 | Brittingham | |
| 2010/0126334 | A1 | 5/2010 | Shults et al. | |
| 2010/0139145 | A1 | 6/2010 | Brittingham | |
| 2010/0163336 | A1 | 7/2010 | Presz, Jr. et al. | |
| 2011/0056111 | A1 | 3/2011 | Brittingham | |
| 2011/0088540 | A1 | 4/2011 | Brittingham | |
| 2011/0179945 | A1 | 7/2011 | Clark et al. | |
| 2011/0297477 | A1 | 12/2011 | Koumbis | |
| 2012/0145478 | A1 | 6/2012 | Brittingham | |
| 2012/0152093 | A1 | 6/2012 | Koumbis | |
| 2012/0152649 | A1 | 6/2012 | Larue | |
| 2012/0199415 | A1 | 8/2012 | Shults et al. | |
| 2012/0272818 | A1 | 11/2012 | Dueck et al. | |
| 2012/0279381 | A1 | 11/2012 | Landolt | |

FOREIGN PATENT DOCUMENTS

| | | | |
|---|---|---|---|
| CA | 1227078 | A1 | 7/1984 |
| CA | 2145066 | A1 | 8/1993 |
| CA | 2339381 | A1 | 5/2000 |
| CA | 2397484 | A1 | 12/2000 |
| CA | 2397484 | C | 12/2000 |
| CA | 2503772 | A1 | 2/2004 |
| CA | 2503772 | C | 2/2004 |
| CH | 381569 | A | 3/1961 |
| CH | 680015 | A5 | 1/1991 |
| DE | 1553874 | A1 | 2/1967 |
| DE | 2540419 | A1 | 9/1975 |
| DE | 4101171 | A1 | 1/1991 |
| EP | 0072592 | A2 | 8/1982 |
| EP | 0071798 | B1 | 5/1986 |
| EP | 0071799 | B1 | 11/1986 |
| EP | 0148984 | B1 | 6/1988 |
| EP | 0660915 | B1 | 5/1997 |
| EP | 1117970 | B1 | 1/2004 |
| EP | 1247057 | B1 | 3/2004 |
| EP | 1592939 | B1 | 7/2006 |
| FR | 492535 | A | 11/1915 |
| GB | 189906701 | A | 3/1899 |
| GB | 581974 | A | 10/1946 |
| GB | 2333826 | A | 1/1998 |
| IL | 66462 | | 8/1982 |
| IL | 72399 | | 7/1984 |

(56) References Cited

FOREIGN PATENT DOCUMENTS

| | | | |
|---|---|---|---|
| IT | 1252609 | B | 1/1991 |
| JP | 6241691 | A | 9/1994 |
| KR | 20060002762 | A | 8/2005 |
| PT | 1592939 | E | 2/2004 |
| WO | 8903958 | A1 | 5/1989 |
| WO | 9407103 | A2 | 8/1993 |
| WO | 9603612 | A1 | 2/1996 |
| WO | 0109560 | A1 | 7/2000 |
| WO | 0151873 | A1 | 12/2000 |
| WO | 2011035111 | A1 | 3/2011 |
| WO | 2012083203 | A2 | 12/2011 |

* cited by examiner

SUPPRESSOR ASSEMBLY FOR A FIREARM

CROSS-REFERENCE TO RELATED APPLICATIONS

The present application is a continuation of U.S. patent application Ser. No. 13/862,702, filed Apr. 15, 2013, entitled "SUPPRESSOR ASSEMBLY FOR A FIREARM, which claims priority to and the benefit of U.S. Provisional Patent Application No. 61/750,613, filed Jan. 9, 2013, entitled "SUPPRESSOR ASSEMBLY FOR A FIREARM," which are both herein incorporated by reference in their entirety.

FIELD OF THE DISCLOSURE

The disclosure generally relates to a firearm and more particularly relates to a suppressor assembly for a firearm.

BACKGROUND

Suppressor assemblies are configured to compensate for the various effects of firing a projectile (such as a bullet) from a firearm. Some of the effects include, but are not limited to, muzzle jump, muzzle recoil, muzzle blast, and/or muzzle flash. For example, muzzle jump and muzzle recoil can adversely impact accuracy by altering the position of the firearm after each shot. Muzzle blast is the loud noise that generally accompanies the discharge of a firearm. The muzzle blast can damage the ears of the operator or nearby individuals not wearing ear protection and can bring unwanted attention in instances of covert use. Muzzle flash is the bright flash that generally accompanies the discharge of a firearm. The muzzle flash can adversely affect vision and draw unwanted attention to the use of the firearm.

SUMMARY

Some or all of the above needs and/or problems may be addressed by certain embodiments of the suppressor assembly for a firearm disclosed herein. According to an embodiment, the firearm may include a barrel, a bore, and a muzzle end. The suppressor assembly may include a gas block mount positioned about the barrel. The suppressor assembly also may include an outer tube having a first end and a second end. The first end of the outer tube may be configured to be attached to the gas block mount, and the second end of the outer tube may be configured to extend beyond the muzzle end of the firearm. Moreover, the suppressor assembly may include a baffle comprising a first end and a second end. The second end of the baffle may be configured to be attached to and positioned within the second end of the outer tube.

Other features and aspects of the suppressor assembly will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
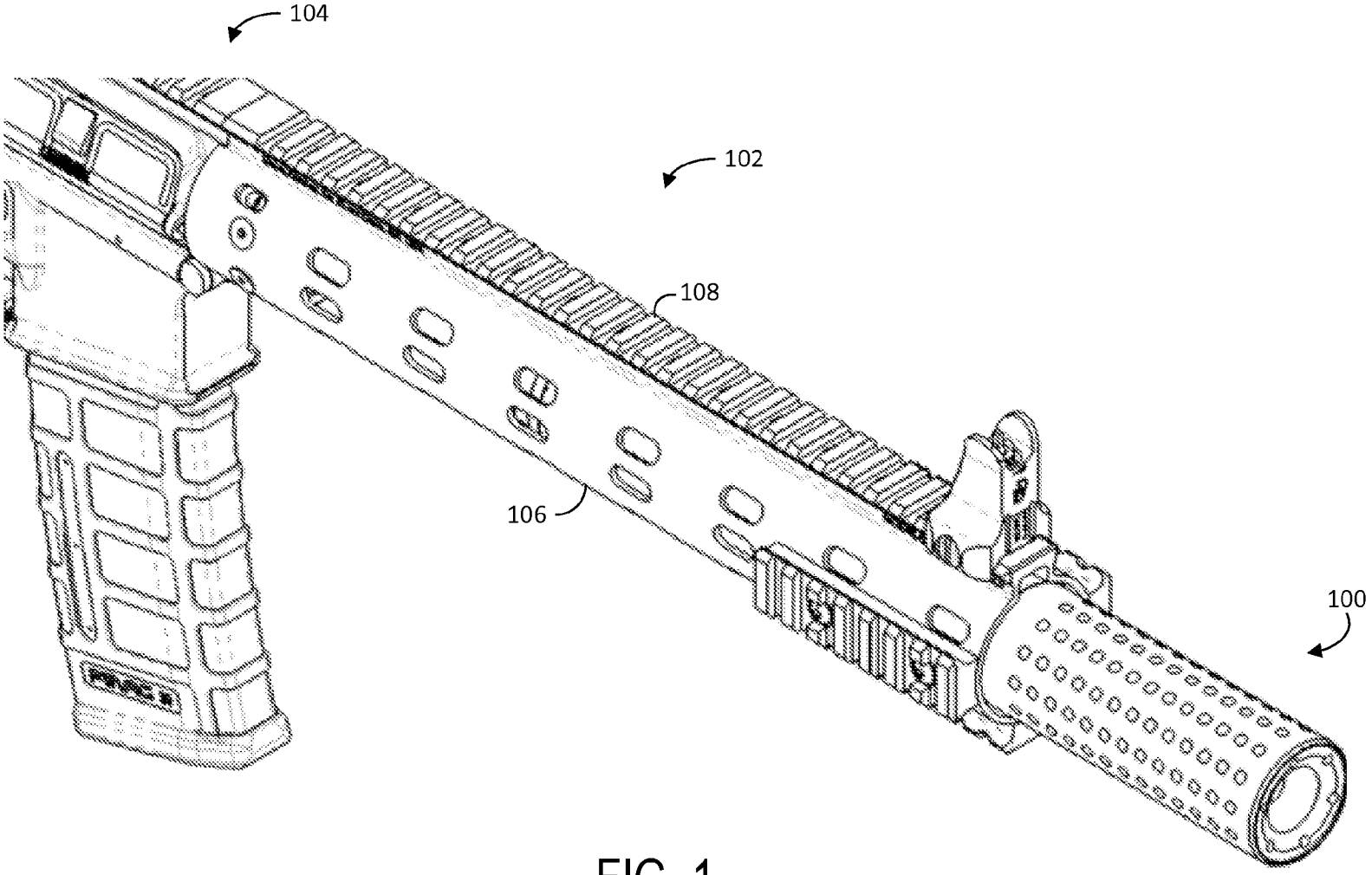
FIG. 1 schematically depicts an upper perspective view of a suppressor assembly attached to a firearm in accordance with one or more embodiments of the disclosure.

Described below are embodiments of a suppressor assembly (as well as individual components of the suppressor assembly) that can be attached to a firearm. Methods of installing the suppressor assembly on the firearm are also disclosed. The firearm may be a conventional firearm. For example, the firearm may be an M-16 style rifle, an AR-15 style rifle, an AR-10 style rifle, or an M-4 style rifle, among others. The suppressor assembly may be configured to reduce the muzzle jump, muzzle recoil, muzzle blast, and/or muzzle flash generated by the firing of the firearm by slowing, expanding, trapping, and/or cooling the propellant gases associated with the firing of the firearm.

Generally speaking, the suppressor assembly may include an outer tube, a gas block mount, and a baffle. In certain embodiments, the outer tube may include an elongated hollow body having a first end and a second end. The first end may be configured to be attached to the gas block mount. For example, the first end may include internal threads that correspond to external threads on the gas block mount. In this manner, the first end of the outer tube may be screwed onto the gas block mount. In some instances, the first end of the outer tube may include an increased thickness to compensate for the internal threads therein and provide a more robust and sturdy connection to the gas block mount. The second end of the outer tube may be configured to be attached to the baffle. For example, the second end of the outer tube may include internal threads that correspond to external threads on the baffle. In this manner, the baffle may be screwed into and positioned within the second end of the outer tube. In some instances, the second end of the outer tube may include an increased thickness about the baffle. The increased thickness on the second end of the outer tube may provide additional support against the pressures associated with the expansion of the propellant gases within the baffle. The outer surface on the second end of the outer tube may include a number of dimples. The dimples may be configured to dissipate heat, provide a gripping surface, and/or be visual appealing.

The gas block mount may be positioned about a barrel of the firearm along a longitudinal length of the barrel. In some instances, the gas block mount may include one or more gas ports in communication with a bore of the barrel. As noted above, the gas block mount may include external threads. The external threads may be configured to receive the internal threads on the first end of the outer tube. In this manner, the gas block mount may be configured to be attached to the first end of the outer tube. For example, the first end of the outer tube may be screwed onto the gas block mount.

In certain embodiments, the baffle may comprise a monocore baffle. That is, the baffle may be a single unibody assembly. The baffle may include a first end (e.g., an entry end) and a second end (e.g., an exit end). The second end of the baffle may be configured to be attached to the second end of the outer tube. For example, the second end of the baffle may include external threads that correspond to internal threads within the second end of the outer tube. In this manner, the second end of the baffle may be screwed into the second end of the outer tube, thereby securing the baffle within the second end of the outer tube. The baffle may also include a bore configured to receive a projectile therethrough. The bore may extend between the first end of the baffle and the second end of the baffle. That is, the bore may extend through a longitudinal axis of the baffle. In some instances, the bore may taper outward (e.g., at a thirty degree angle per side relative to the longitudinal axis of the baffle) at the second end of the baffle. The outward taper of the bore at the second end of the baffle may form a generally conical frustum-shaped projectile exit. In some instances, the first end of the baffle may taper inward towards the muzzle end of the firearm. In certain embodiments, a number of angled ports may extend outward from the bore of the baffle. For example, in certain embodiments, each of the angled ports may form a sixty degree angle per side relative to the longitudinal axis of the baffle. The angled ports may be arranged circumferentially about the baffle in a series of rows. For example, in certain embodiments, the baffle may include five rows of angled ports, with each row having eight circumferentially arranged angled ports. In some instances, a rib may be formed between and about each row of angled ports. An outer diameter of each rib may correspond to an inner diameter of the outer tube; however, in other instances, a small clearance may exist between the ribs and the outer tube. In certain embodiments, the outer surface of the baffle may be recessed between each of the ribs. That is, the outer surface may be concave between each of the ribs. A front surface of the baffle may include a number of circumferentially arranged holes. The circumferentially arranged holes may be configured to cooperate with a tool (e.g., a spanner wrench or the like) for the attachment of the baffle to the outer tube.

As assembled, the second end of the baffle can be attached to the second end of the outer tube, and the first end of the outer tube can be attached to the gas block mount. The first end of the baffle may be spaced apart from the muzzle of the firearm, and the outer tube may form a chamber about at least a portion of the barrel of the firearm. The chamber may extend beyond the muzzle end of the firearm. Accordingly, the propellant gases associated with the firing of the firearm may be expanded, slowed, trapped, and/or cooled within the chamber and/or the angled ports. The propellant gases may then exit the suppressor assembly via the exit end of the baffle. As a result, the muzzle jump, muzzle recoil, muzzle blast, and/or muzzle flash generated by the firing of the firearm may be reduced or substantially eliminated.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

FIGS. 1-12 schematically depict a suppressor assembly (as well as individual components of the suppressor assembly) that can be attached to a firearm in accordance with one or more embodiments of the disclosure. Specifically, FIG. 1 schematically depicts a suppressor assembly 100 attached to a firearm 102. The firearm 102 may be a conventional firearm. By way of example, the firearm 102 may be any number of firearms, such as, but not limited to, an M-16 style rifle, an AR-15 style rifle, an AR-10 style rifle, or an M-4 style rifle, or the like. Moreover, the firearm 102 may be a handgun or the like. As depicted in FIG. 1, the firearm 102 may generally include an upper receiver 104. The upper receiver 104 generally houses internal components of the firearm 102 and is not shown in the figures. The firearm 102 also generally includes a hand guard assembly 106 positioned at least partially about a barrel. The barrel extends from the upper receiver 104 along a longitudinal axis and may be secured or otherwise mounted to the upper receiver 104 using, for example, a barrel nut or the like. The hand guard assembly 106 also may extend from the upper receiver 104 and may be secured or otherwise mounted to the upper receiver 104. In some instances, the hand guard assembly 106 may include a rail system 108 or the like. The rail system 108 may be configured to attach a number of accessories to the hand guard assembly 106. In other instances, the hand guard assembly 106 and/or the rail system 108 may be omitted.

Figure 2:
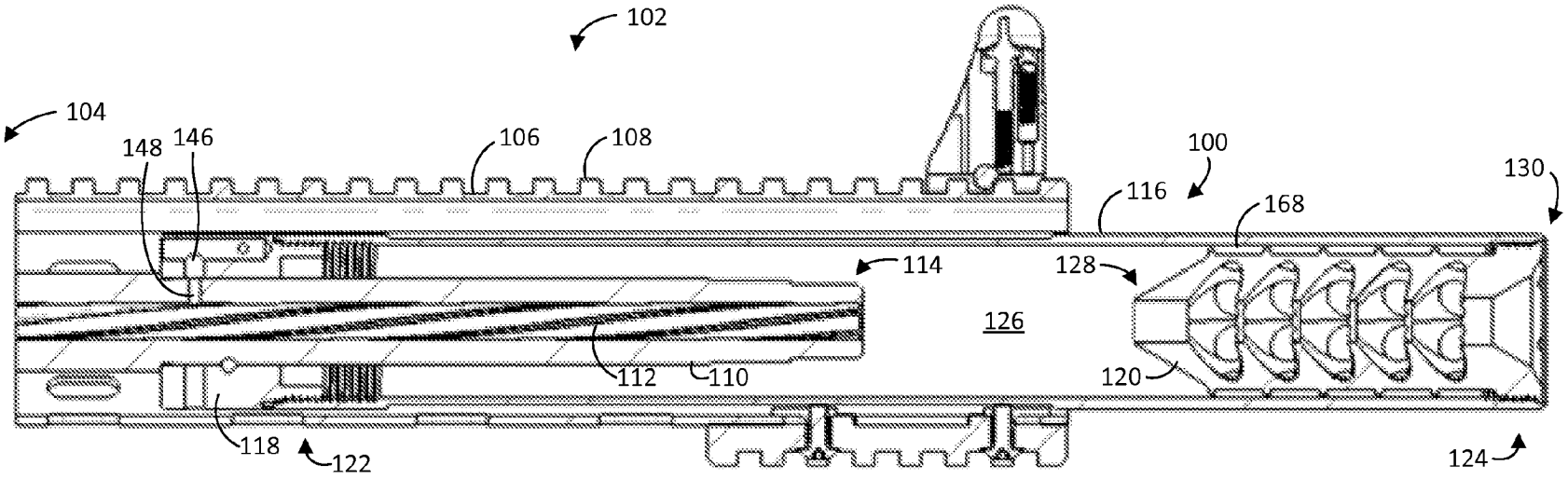
FIG. 2 schematically depicts a cross-sectional view of a suppressor assembly attached to a firearm in accordance with one or more embodiments of the disclosure.

FIG. 2 schematically depicts a cross-sectional view of the suppressor assembly 100 attached to the firearm 102 in accordance with one or more embodiments of the disclosure. In certain embodiments, the firearm 102 may include a barrel 110, a bore 112, and a muzzle end 114. As noted above, the barrel 110 may extend from the upper receiver 104 along a longitudinal axis and may be secured or otherwise mounted to the upper receiver 104. The bore 112 may extend through the center of the barrel 110 along the longitudinal axis. The distal end of the barrel 110 may form the muzzle end 114 of the firearm 102.

The suppressor assembly 100 may generally include an outer tube 116, a gas block mount 118, and a baffle 120. The outer tube 116, the gas block mount 118, and the baffle 120 may be configured to individually or collectively expand, slow, trap, and/or cool the propellant gases associated with the firing of the firearm 102. In some instances, the suppressor assembly 100 may be positioned about the barrel 110 and may be at least partially positioned within the hand guard assembly 106.

In certain embodiments, the gas block mount 118 may be positioned about the barrel 110. For example, the gas block mount 118 may be positioned about the barrel 110 at any location between the upper receiver 104 and the muzzle end 114 of the firearm 102. The outer tube 116 may include a first end 122 and a second end 124. The first end 122 of the outer tube 116 may be configured to be attached to the gas block mount 118. Conversely, the second end 124 of the outer tube 116 may be configured to extend beyond the muzzle end 114 of the firearm 102. In this manner, the outer tube 116 may form a chamber 126 about at least a portion of the barrel 110 of the firearm 102. The chamber 126 may also extend at least partially beyond the muzzle end 114 of the firearm 102. The baffle 120 may include a first end 128 and a second end 130. The second end 130 of the baffle 120 may be configured to be attached to and positioned within the second end 124 of the outer tube 116. In this manner, when assembled, the first end 128 of the baffle 120 may be spaced apart from the muzzle end 114 of the firearm 102. That is, at least a portion of the chamber 126 may be formed between the muzzle end 114 of the firearm 102 and the first end 128 of the baffle 120. Moreover, a portion of the chamber 126 may be formed between the barrel 110 of the firearm 102 and the outer tube 116.

Figure 3:
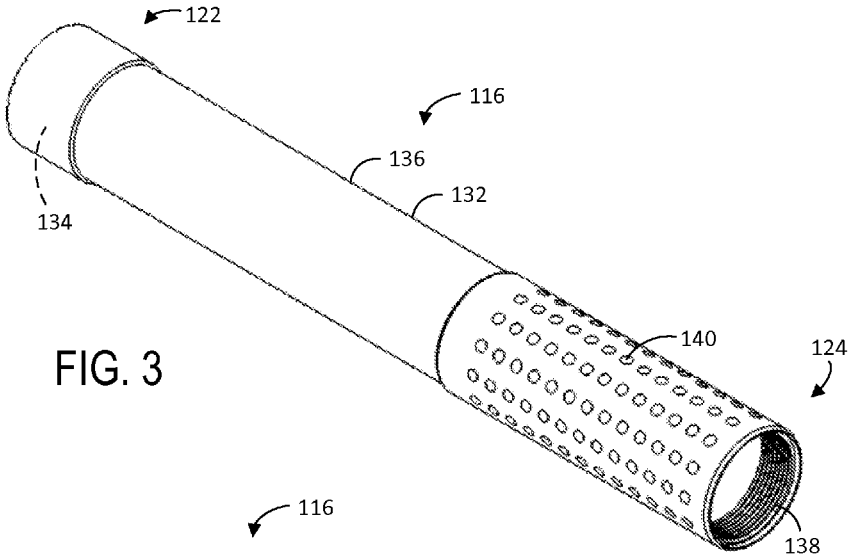
FIG. 3 schematically depicts an upper perspective view of an outer tube in accordance with one or more embodiments of the disclosure.
Figure 4:
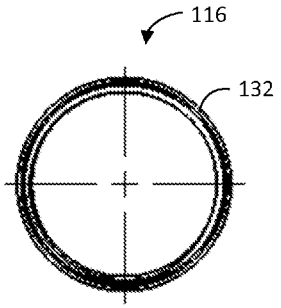
FIG. 4 schematically depicts a front view of an outer tube in accordance with one or more embodiments of the disclosure.
Figure 5:
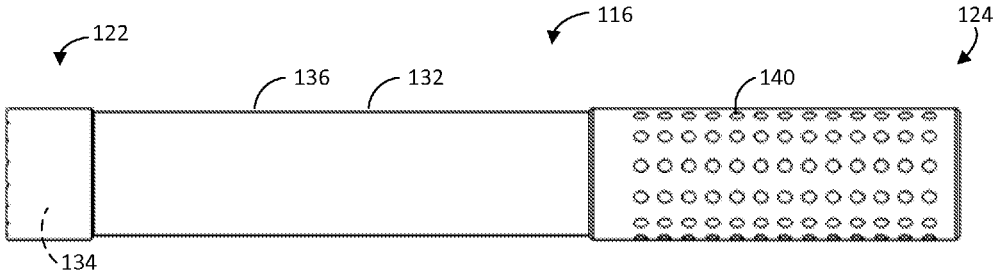
FIG. 5 schematically depicts a side view of an outer tube in accordance with one or more embodiments of the disclosure.
Figure 6:
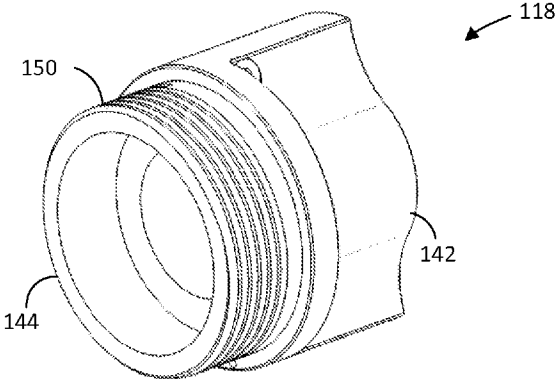
FIG. 6 schematically depicts an upper perspective view of a gas block mount in accordance with one or more embodiments of the disclosure.
Figure 8:
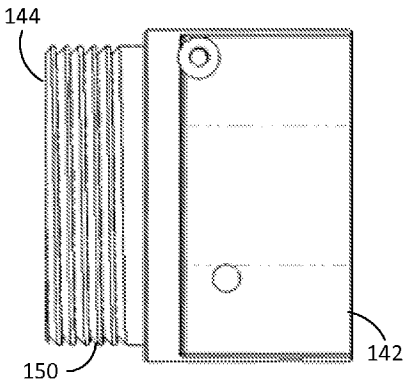
FIG. 8 schematically depicts a side view of a gas block mount in accordance with one or more embodiments of the disclosure.
Figure 7:
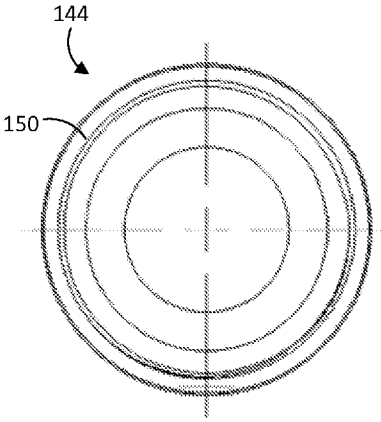
FIG. 7 schematically depicts a front view of a gas block mount in accordance with one or more embodiments of the disclosure.
Figure 9:
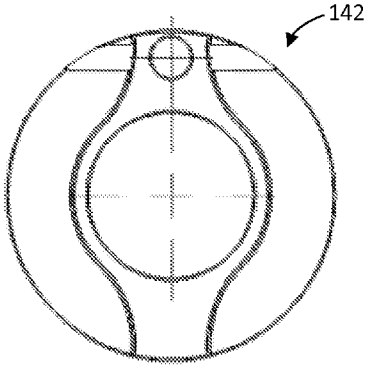
FIG. 9 schematically depicts a back view of a gas block mount in accordance with one or more embodiments of the disclosure.

FIGS. 3-5 schematically depict the outer tube 116 in accordance with one or more embodiments of the disclosure. In some instances, the outer tube 116 may comprise an elongated hollow body 132. The elongated hollow body 132 may extend between the first end 122 and the second end 124 of the outer tube 116.

The first end 122 of the outer tube 116 may be configured to be attached to the gas block mount 118. For example, the first end 122 of the outer tube 116 may include internal threads 134 that correspond to external threads on the gas block mount 118. In this manner, the first end 122 of the outer tube 116 may be screwed onto the gas block mount 118. Other attachment configurations between the outer tube 116 and the gas block mount 118 are also possible including, but not limited to, welding, pressure fitting, snapping-on, bolting, etc., the outer tube 116 to the gas block mount 118. In some instances, the first end 122 of the outer tube 116 may comprise an increased thickness to compensate for the internal threads 134 therein. That is, the outer diameter of the first end 122 of the outer tube 116 may be greater than the outer diameter of a middle portion 136 of the outer tube 116 adjacent to the first end 122 of the outer tube 116. The increased thickness may provide a more robust and sturdy connection between the outer tube 116 and the gas block mount 118. In other instances, the inner and outer diameter of the outer tube 116 may be constant along the entire length of the outer tube 116.

The second end 124 of the outer tube 116 may be configured to be attached to the baffle 120. For example, the second end 124 of the outer tube 116 may include internal threads 138 that correspond to external threads on the baffle 120. In this manner, the baffle 120 may be screwed into and positioned within the second end 124 of the outer tube 116. Other attachment configurations between the outer tube 116 and the baffle 120 are also possible including, but not limited to, welding, pressure fitting, snapping-on, bolting, etc., the baffle 120 to the second end 124 of the outer tube 116. In some instances, the second end 124 of the outer tube 116 may include an increased thickness about the baffle 120. That is, the outer diameter of the second end 124 of the outer tube 116 may be greater than the outer diameter of the middle portion 136 of the outer tube 116 adjacent to the second end 124 of the outer tube 116. The increased thickness of the second end 124 of the outer tube 116 may compensate for the internal threads 138 therein and may provide additional support against the pressures associated with the expansion of the propellant gases within the baffle 120.

In certain embodiments, the outer surface of the second end 124 of the outer tube 116 may include a number of dimples 140. In some instances, the dimples 140 may be arranged circumferentially about the second end 124 of the outer tube 116 in a series of rows. Any number of dimples 140 may be disposed on the outer surface of the second end 124 of the outer tube 116. In other instances, the dimples 140 may be omitted. The dimples 140 may be configured to dissipate heat, provide a gripping surface, and/or be visually appealing. Alternatively, or in addition to the dimples 140, one or more slits or grooves may be disposed on the second end 124 of the outer tube 116.

FIGS. 6-9 schematically depict the gas block mount 118 in accordance with one or more embodiments of the disclosure. The gas block mount 118 may include a first end 142 and a second end 144. The gas block mount 118 may be positioned about the barrel 110 of the firearm 102 along the longitudinal length of the barrel 110. For example, the gas block mount 118 may be positioned about the barrel 110 at any location between the upper receiver 104 and the muzzle end 114 of the firearm 102. In certain embodiments, the first end 142 of the gas block mount 118 may be attached to the barrel 110 by any means known in the art, such as, but not limited to, welded, screwed, bolted, pressure fitted, etc. For example, the inner diameter of the first end 142 of the gas block mount 118 may substantially correspond to an outer diameter of the barrel 110.

In some instances, the gas block mount 118 may include one or more gas ports 146, as depicted in FIG. 2, in communication with the bore 112 of the barrel 110. For example, the gas ports 146 may be in fluid communication with the bore 112 by way of one or more bore ports 148, as depicted in FIG. 2. In this manner, the gas block mount 118 may be configured to divert at least a portion of the propellant gases associated with the firing of the firearm 102. The diverted portion of the propellant gases may be delivered to the upper receiver 104 via one or more gas tubes or the like.

As noted above, in certain embodiments, the gas block mount 118 may include external threads 150. For example, the external threads 150 may be disposed about the second end 144 of the gas block mount 118. The external threads 150 may be configured to receive the internal threads 134 on the first end 122 of the outer tube 116. In this manner, the second end 144 of the gas block mount 118 may be configured to be attached to the first end 122 of the outer tube 116. That is, in some instances, the first end 122 of the outer tube 116 may be screwed onto the second end 144 of the gas block mount 118. In other instances, the first end 122 of the outer tube 116 may be welded, screwed, bolted, pressure fitted, etc., to the second end 144 of the gas block mount 118. Moreover, in some instances, the inner diameter of the second end 144 of the gas block mount 118 may be greater than the outer diameter of the barrel 110. In this manner, at least a portion of the second end 144 of the gas block mount 118 may be spaced apart from the barrel 110 and/or may form a portion of the chamber 126.

Figure 10:
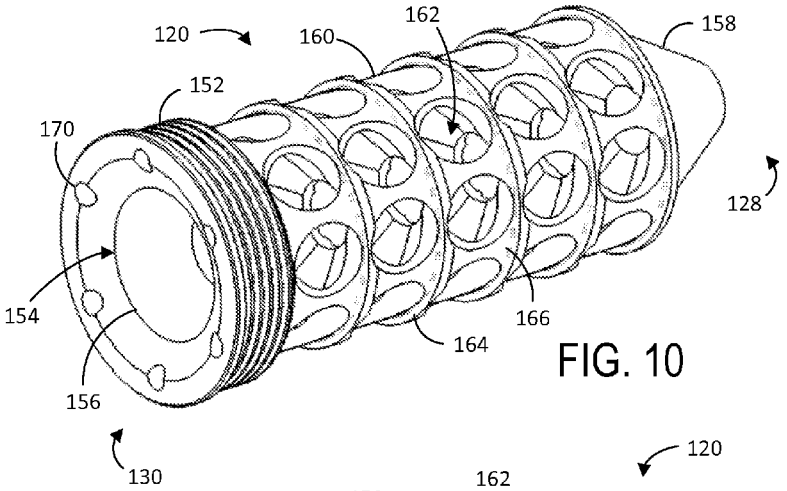
FIG. 10 schematically depicts an upper perspective view of a baffle in accordance with one or more embodiments of the disclosure.
Figure 11:
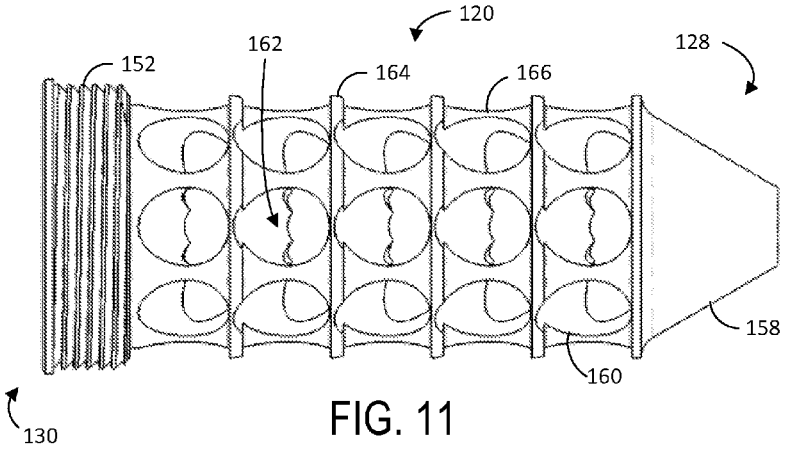
FIG. 11 schematically depicts a side view of a baffle in accordance with one or more embodiments of the disclosure.
Figure 12:
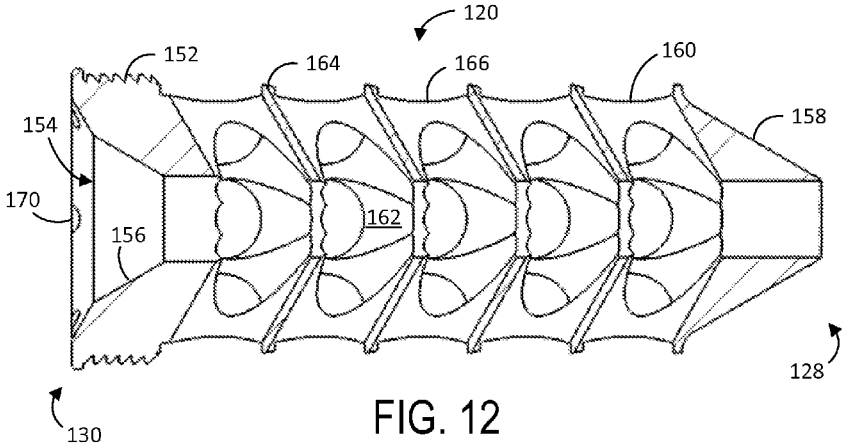
FIG. 12 schematically depicts a cross-sectional view of a baffle in accordance with one or more embodiments of the disclosure.

FIGS. 10-12 schematically depict the baffle 120 in accordance with one or more embodiments of the disclosure. In certain embodiments, the baffle 120 may comprise a monocore baffle. That is, the baffle 120 may be a single unibody assembly. For example, the baffle 120 may be machined out of a single piece of metal, ceramic, or other suitable material. As noted above, the baffle 120 may include a first end 128 and a second end 130. The first end 128 of the baffle 120 may comprise the entry end of the baffle 120. That is, the first end 128 of the baffle 120 may be configured to receive a projectile and the associated propellant gases exiting the muzzle end 114 of the firearm 102. Conversely, the second end 130 of the baffle 120 may comprise the exit end of the baffle 120. That is, the second end 130 of the baffle 120 may be configured to expel the projectile and the associated propellant gases from the baffle 120.

In certain embodiments, the second end 130 of the baffle 120 may be configured to be attached to the second end 124 of the outer tube 116. For example, the second end 130 of the baffle 120 may include external threads 152 that correspond to the internal threads 138 within the second end 124 of the outer tube 116. In this manner, the second end 130 of the baffle 120 may be screwed into the second end 124 of the outer tube 116, thereby securing the baffle 120 within the second end 124 of the outer tube 116. Other attachment configurations between the baffle 120 and the outer tube 116 are also possible including, but not limited to, welding, pressure fitting, snapping-on, bolting, etc., the baffle 120 to the outer tube 116.

The baffle 120 may include a bore 154. The bore 154 may extend between the first end 128 of the baffle 120 and the second end 130 of the baffle 120. The bore 154 may extend through a longitudinal axis of the baffle 120. The projectile and the associated propellant gases may pass through the bore 154. In this manner, the bore 154 of the baffle 120 may be substantially aligned with the bore 112 of the barrel 110. In some instances, the bore 154 may taper outward at the second end 130 of the baffle 120. For example, the bore 154 may taper outward at a thirty degree angle per side relative to the longitudinal axis of the baffle 120, although other angles and configurations are possible. The outward taper of the bore 154 at the second end 130 of the baffle 120 may form a generally conical frustum-shaped projectile exit 156, which may aid in the cooling, expanding, slowing, etc., of the propellant gases as they exit the baffle 120. In other instances, the bore 154 may not taper outward at the second end 130 of the baffle 120. In yet other instances, the bore 154 may taper outward even further after the generally conical frustum-shaped projectile exit 156 at the second end 130 of the baffle 120.

In some instances, the first end 128 of the baffle 120 may taper inward 158 towards the muzzle end 114 of the firearm 102. For example, the first end 128 of the baffle 120 may taper inward 158 at a thirty degree angle, although other angles are possible. The inward taper 158 at the first end 128 of the baffle 120 may aid in the entry of the propellant gases to the baffle 120 and also may aid in the flow of the propellant gases within the chamber 126.

In certain embodiments, a number of angled ports 160 may extend outward from the bore 154 of the baffle 120. For example, in certain embodiments, each of the angled ports 160 may form a sixty degree angle per side relative to the longitudinal axis of the baffle 120. The angled ports 160 may be arranged circumferentially about the baffle 120 in a series of rows. For example, in certain embodiments, the baffle 120 may include five rows of angled ports 160, with each row having eight circumferentially arranged angled ports 160. In some embodiments, depending on the size and arrangement of the angled ports 160, each row of angled ports 160 may form a baffle chamber 162 within the baffle 120. That is, depending on the diameter of each of the angled ports 160, each of the angled ports 160 in a row may intersect adjacent angled ports 160 in the same row, thereby forming a baffle chamber 162 within each row.

In some instances, a rib 164 may be formed between and/or about each row of the angled ports 160. An outer diameter of each rib 164 may correspond to an inner diameter of the outer tube 116; however, in other instances, a small clearance may exist between the ribs 164 and the inner diameter of the outer tube 116. In certain embodiments, the outer surface of the baffle 120 may include a recessed surface 166 between each of the ribs 164. For example, the outer recessed surface 166 may form a concaved surface between each of the ribs 164. Moreover, the outer recessed surface 166, the adjacent ribs 164, and the outer tube 116 may collectively define one or more of the outer baffle chambers 168 therebetween, as depicted in FIG. 2. For example, each of the outer baffle chambers 168 may be in fluid communication with a row of angled ports 160.

In some instances, a front surface of the baffle 120 may include a plurality of holes 170. In certain embodiments, the plurality of holes 170 may be arranged circumferentially about the front surface of the baffle 120. In this manner, the circumferentially arranged holes 170 may be configured to cooperate with a tool, such as, but not limited to, a spanner wrench or the like for the attachment of the baffle 120 to the outer tube 116.

The suppressor assembly 100 may be configured to reduce the muzzle jump, muzzle recoil, muzzle blast, and/or muzzle flash generated by the firing of the firearm 102. That is, the suppressor assembly 100 may slow, expand, trap, and/or cool the propellant gases associated with the firing of the firearm 102. For example, a portion of the propellant gases may be initially diverted by the gas block mount 118 and delivered to the upper receiver 104 via one or more gas tubes or the like. The remainder of the propellant gases may exit the muzzle end 114 of the firearm 102 into the chamber 126. The propellant gases also may enter the baffle 120, wherein the propellant gases may pass through and/or between the angled ports 160, the baffle chambers 162, the ribs 164, and/or the outer baffle chambers 168. The propellant gases may then exit the suppressor assembly 100 by way of the exit end (i.e., the second end 130) of the baffle 120.

Illustrative Methods

Figure 13:
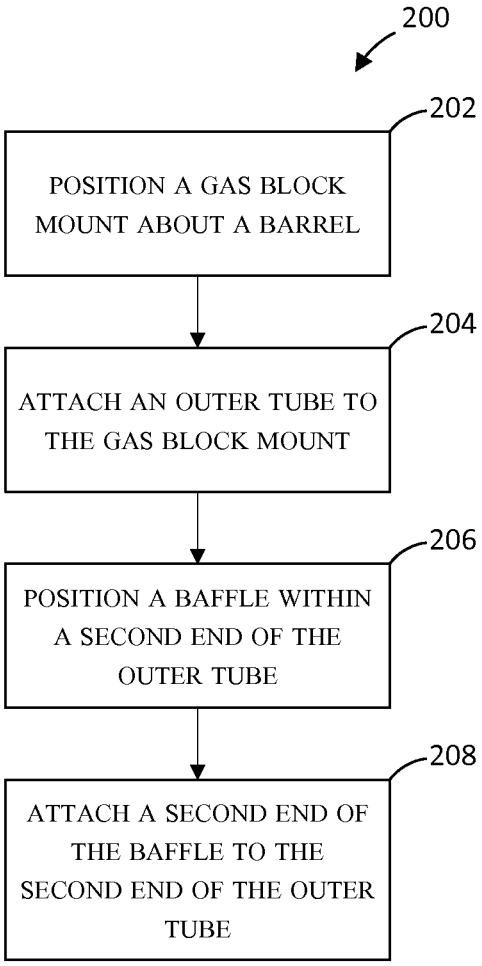
FIG. 13 is a flow diagram depicting an illustrative method for attaching a suppressor assembly to a firearm in accordance with one or more embodiments of the disclosure.

FIG. 13 is a flow diagram depicting an illustrative method 200 for attaching the suppressor assembly 100 to the firearm 102 in accordance with one or more embodiments of the disclosure.

At block 202 of method 200, the gas block mount 118 may be positioned about the barrel 110. That is, the gas block mount 118 may be positioned about the barrel 110 of the firearm 102 along the longitudinal length of the barrel 110. For example, the gas block mount 118 may be positioned about the barrel 110 at any location between the upper receiver 104 and the muzzle end 114 of the firearm 102. In certain embodiments, the first end 142 of the gas block mount 118 may be attached to the barrel 110 by any means known in the art. That is, the gas block mount 118 may be welded, screwed, bolted, pressure fitted, etc., to the barrel 110. In some instances, the inner diameter of the first end 142 of the gas block mount 118 may substantially correspond to an outer diameter of the barrel 110.

Upon positioning the gas block mount 118 about the barrel 110 at block 202, the outer tube 116 may be attached to the gas block mount 118 at block 204. That is, the first end 122 of the outer tube 116 may be configured to be attached to the gas block mount 118. For example, the first end 122 of the outer tube 116 may include internal threads 134 that correspond to external threads on the gas block mount 118. In this manner, the first end 122 of the outer tube 116 may be screwed onto the gas block mount 118. Other attachment configurations between the outer tube 116 and the gas block mount 118 are also possible. For example, the outer tube 116 may be welded, screwed, bolted, pressure fitted, etc., to the gas block mount 118. In some instances, the dimpled surface 140 of the second end 124 of the outer tube 116 may be grasped when screwing the outer tube 116 onto the gas block mount 118. In other instances, a tool may be used to attach the outer tube 116 onto the gas block mount 118.

After the outer tube 116 has been attached to the gas block mount 118 at block 204, the baffle 120 may be positioned within the second end 124 of the outer tube 116 at block 206. At block 208 of method 200, the second end 130 of the baffle 120 may be attached to the second end 124 of the outer tube 116. For example, the second end 130 of the baffle 120 may include external threads 152 that correspond to the internal threads 138 within the second end 124 of the outer tube 116. In this manner, the second end 130 of the baffle 120 may be screwed into the second end 124 of the outer tube 116, thereby securing the baffle 120 within the second end 124 of the outer tube 116. In other instances, the baffle 120 may be welded, pressure fitted, snapped-on, bolted, etc., to the outer tube 116. In certain embodiments, the circumferentially arranged holes 170 on the front surface of the baffle 120 may be configured to cooperate with a tool, such as, but not limited to, a spanner wrench or the like for the attachment of the baffle 120 to the outer tube 116. The spanner wrench and the circumferentially arranged holes 170 may cooperate together to facilitate the tightening of the baffle 120 to the outer tube 116 and/or the outer tube 116 to the gas block mount 118.

In certain embodiments, the baffle 120 may be attached to the outer tube 116, and the outer tube 116 then may be attached to the gas block mount 118. That is, the steps described in blocks 202-208 of method 200 may be performed in any order. Moreover, certain steps may be omitted, while other steps may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A suppressor assembly attached to a firearm, the firearm having a barrel, a bore, and a muzzle end, the suppressor assembly comprising:

a gas block mount comprising a first end and a second end, wherein the gas block mount is positioned about the barrel and spaced apart from the muzzle end of the firearm, wherein an inner diameter of the second end of the gas block mount is greater than an outer diameter of the barrel;

an outer tube comprising a first end and a second end, wherein the first end of the outer tube is attached to the second end of the gas block mount, and wherein the second end of the outer tube extends beyond the muzzle end of the firearm;

a baffle comprising a first end and a second end, wherein the second end of the baffle is attached to and positioned within the second end of the outer tube, and wherein the first end of the baffle is spaced apart from the muzzle end of the firearm; and a chamber formed at least partially between the barrel of the firearm and the outer tube, wherein at least a portion of the chamber is formed between the muzzle end and the first end of the baffle, and wherein the gas block mount forms an end cap of the chamber, wherein at least a portion of the second end of the gas block mount is spaced apart from the barrel and forms a portion of the chamber.

2. The suppressor assembly of claim 1, wherein the first end of the gas block mount is attached to the barrel.

3. The suppressor assembly of claim 2, further comprising external threads disposed on an outer surface of the second end of the gas block mount.

4. The suppressor assembly of claim 1, further comprising:

internal threads disposed within the first end of the outer tube; and external threads disposed on the gas block mount, wherein the internal threads within the first end of the outer tube correspond to the external threads on the gas block mount, and wherein the first end of the outer tube is configured to be screwed onto the gas block mount.

5. The suppressor assembly of claim 1, wherein the outer tube comprises an increased thickness at the first end of the outer tube about the gas block mount.

6. The suppressor assembly of claim 1, further comprising:

internal threads disposed within the second end of the outer tube; and external threads disposed on the second end of the baffle, wherein the internal threads within the second end of the outer tube correspond to the external threads on the second end of the baffle, and wherein the second end of the baffle is configured to be screwed into the second end of the outer tube.

7. The suppressor assembly of claim 1, wherein the outer tube comprises an increased thickness at the second end of the outer tube about the baffle.

8. The suppressor assembly of claim 1, further comprising a plurality of dimples disposed on an outer surface of the second end of the outer tube.

9. The suppressor assembly of claim 1, further comprising a baffle bore disposed between the first end of the baffle and the second end of the baffle, wherein the baffle bore is configured to receive a projectile therethrough, wherein the baffle bore comprises an outward taper at the second end of the baffle, and wherein the outward taper at the second end of the baffle defines a conical frustum-shaped exit.

10. The suppressor assembly of claim 1, wherein the first end of the baffle comprises an inward taper towards the muzzle end of the firearm.

11. The suppressor assembly of claim 1, further comprising a plurality of angled ports positioned within the baffle, wherein the plurality of angled ports are arranged circumferentially about the baffle in a series of rows, wherein each row of the angled ports forms a baffle chamber therein.

12. The suppressor assembly of claim 11, further comprising a rib disposed between and about each row of the plurality of angled ports.

13. The suppressor assembly of claim 12, wherein an outer diameter of each rib corresponds to an inner diameter of the outer tube.

14. The suppressor assembly of claim 12, wherein a clearance exists between each of the ribs and the outer tube.

15. The suppressor assembly of claim 12, wherein an outer surface of the baffle comprises a concave recess between each of the ribs, and wherein the concave recess between the adjacent ribs and the outer tube collectively define one or more outer baffle chambers therebetween.

16. The suppressor assembly of claim 1, further comprising a plurality of circumferentially arranged holes disposed on a front surface of the baffle, wherein the plurality of circumferentially arranged holes are configured to cooperate with a tool for the attachment of the baffle to the outer tube.

17. A suppressor assembly attached to a firearm, the firearm having a barrel, a bore, and a muzzle end, the suppressor assembly comprising:

a gas block mount comprising a first end and a second end, wherein the gas block mount is positioned about the barrel and spaced apart from the muzzle end of the firearm, wherein an inner diameter of the second end of the gas block mount is greater than outer diameter of the barrel;

an outer tube comprising a first end and a second end, wherein the first end of the outer tube is attached to the second end of the gas block mount, and wherein the second end of the outer extends beyond the muzzle end of the firearm;

a baffle attached to and positioned within the outer tube; and a chamber formed at least partially between the barrel of the firearm and the outer tube, wherein at least a portion of the chamber is formed between the muzzle end and the first end of the baffle, wherein at least a portion of the second end of the gas block mount is spaced apart from the barrel and forms a portion of the chamber.

18. A method for assembling a suppressor assembly on a firearm, the firearm having a barrel, a bore, and a muzzle end, the method comprising:

positioning a gas block mount about the barrel, wherein the gas block mount comprises a first end and a second end, wherein the gas block mount is spaced apart from the muzzle end of the firearm, wherein an inner diameter of the second end of the gas block mount is greater than an outer diameter of the barrel;

attaching an outer tube to the gas block mount, wherein the outer tube comprises a first end and a second end, wherein the first end of the outer tube is attached to the second end of the gas block mount, and wherein the second end of the outer tube extends beyond the muzzle end of the firearm;

positioning a baffle within the second end of the outer tube, wherein the baffle comprises a first end and a second end, wherein the second end of the baffle is attached to and positioned within the second end of the outer tube, and wherein the first end of the baffle is spaced apart from the muzzle end of the firearm; and forming a chamber at least partially between the barrel of the firearm and the outer tube, wherein at least a portion of the chamber is formed between the muzzle end and the first end of the baffle, wherein at least a portion of the second end of the gas block mount is spaced apart from the barrel and forms a portion of the chamber.

* * * * *